United States Patent [19]

Berg

[11] 4,290,475

[45] Sep. 22, 1981

[54] INGOT CASTING

[75] Inventor: Charles A. Berg, Buckfield, Me.

[73] Assignee: Pyreflex Corporation, Buckfield, Me.

[21] Appl. No.: 105,510

[22] Filed: Dec. 20, 1979

Related U.S. Application Data

[63] Continuation-in-part of Ser. No. 10,712, Feb. 9, 1979, Pat. No. 4,256,919.

[51] Int. Cl.[3] ..... B22D 7/10

[52] U.S. Cl. ..... 164/513; 164/250.1; 164/254; 164/412; 249/199

[58] Field of Search ..... 164/51, 52, 61, 122, 164/251, 252, 250, 254, 412

[56] References Cited

U.S. PATENT DOCUMENTS 4,082,414 4/1978 Berg ..... 350/103 X
4,160,577 7/1979 Berg ..... 350/292 X

FOREIGN PATENT DOCUMENTS 46-19430 5/1971 Japan ..... 164/122
173174 11/1960 Sweden ..... 249/199
487710 5/1976 U.S.S.R. ..... 249/199

*Primary Examiner*—Robert D. Baldwin

[57] ABSTRACT

Disclosed is a mold structure for casting large metallic parts such as ingots so as to avoid the formation of the "shrinkage pipe" which normally develops on the exposed top surface of such castings during their solidification. The structure comprises a cap for placement on a mold which includes a diaphragm having a front surface located to intercept radiation emitted from the top surface of the cooling metal mass and to reemit radiation back thereto, and a means for returning radiation emitted from the back surface of the diaphragm such as an infrared reflector or a stack of baffles. The cap may include means for cooling the reflective surface and suitable ports which allow the interior of the mold and cap to be evacuated. Portions of the mold adjacent its open top may be provided with insulation to prevent heat loss from the metal by conduction. Various means for providing make-up heat to the top surface of the metal mass may also be included in the structure.

26 Claims, 8 Drawing Figures

INGOT CASTING

REFERENCE TO RELATED APPLICATIONS

This application is a continuation-in-part of copending U.S. application Ser. No. 10,712, filed Feb. 9, 1979, now U.S. Pat. No. 4,256,919, and entitled Temperature Confining Devices and Method, the disclosure of which is incorporated herein by reference.

BACKGROUND OF THE INVENTION

This invention relates to the casting of large metal parts such as ingots.

When ingots are cast in a mold, the exposed top of the ingot cools much more rapidly than its main body, and as a consequence, the upper part of the metal mass adjacent the open top of the mold contracts more rapidly than the main body of the ingot. This results in a cavity or "pipe" which extends from the top surface of the ingot down into its interior. The shrinkage pipe forms early in the process of solidification. Because of oxidation and other chemical effects on the surface of the shrinkage pipe, the material surrounding the pipe cannot be rolled successfully because the pipe forms an unbonded crack within the rolled ingot.

The most commonly employed method of overcoming this problem involves cutting away the top portion of the ingot and recycling the material surrounding the shrinkage pipe. The loss of this material severely affects the metals industry. For example, in steelmaking the loss of ingot tops due to shrinkage pipe formation reduces manufacturing yields by 20 to 25 percent. While this portion of the metal may be recycled, it nevertheless represents a substantial cost in steel making since in order to produce an ingot for rolling of e.g., 100 tons, approximately 120 tons of steel must be cast.

To overcome this problem, some steel producers burn thermite or similar incendiary material directly on top of the ingot to prevent the rapid cooling which produces the shrinkage pipe. This approach is costly and only partially effective in reducing shrinkage. It is also characterized by a significant environmental problem because metallic particulates and gases are evolved as the incendiary material burns. These are difficult and costly to control.

SUMMARY OF THE INVENTION

The instant invention is based on the realization that the formation of the shrinkage pipe is caused by a more rapid rate of cooling of the cast metal at its exposed top surface as compared with its sides which are cooled as they give up heat to the body of the mold by conduction. More particularly, the invention is based on the realization that the dominant mechanism of heat loss from the exposed top of the ingot is through the emission of thermal, i.e., infrared, radiation. It has been discovered that ingots can be cast in a manner to inhibit or avoid the formation of a shrinkage pipe by returning the emitted thermal radiation back to the top surface of the ingot.

One aspect of the invention provides a mold structure for casting metal ingots having an upper surface shrinkage pipe of reduced size relative to ingots cast in an open top mold. The structure comprises a mold body having a top opening and a mold cap for placement over the opening. The cap comprises a diaphragm of material having a melting point higher than the metal to be cast, which diaphragm has a bottom surface disposed to intercept radiation emitted from and to re-emit radiation back toward the top surface of the liquid metal mass placed in the mold body, and means for returning radiation emitted from the top surface of the diaphragm back thereto. In one embodiment, radiation is returned to the diaphragm by a reflector having a reflectivity of at least 0.5. In another embodiment, a plurality of baffles stacked in parallel on the back side of the diaphragm are employed for this purpose.

In combination with the cap structure, insulation may be positioned on the inside of the mold cavity adjacent its top surface to inhibit conductive heat transfer from the cast metal mass into the mold body. Further, the structure may include means for sealing the cap to the mold and means for producing a subatmospheric pressure within the structure on both sides of the diaphragm. When a roughing vacuum is created within the mold structure, convective heat losses from the top of the ingot are essentially eliminated, the reflective surface is protected against degradation, and chemical effects which produce scale on the top surface of the ingot are minimized.

The invention also contemplates the use of means for heating regions adjacent the top surface of the ingot such as a pair of electrodes for passing alternating current therethrough or an induction heating coil. Advantageously, high frequency alternating current passed through the region is substantially confined to surface layers of the metal as a consequence of the well known "skin effect". The mold cap may also include cooling means and a dome-shaped housing for supporting the atmosphere when the interior of the mold is evacuated.

In another aspect, the invention provides a cap for use with a conventional open top mold which is effective to reduce the size of the shrinkage pipe. The cap includes a housing having a portion for mounting on the mold, a diaphragm designed to intercept radiation emitted from the top surface of the liquid metal and to re-emit radiation back thereto, and a reflector or series of baffles for returning radiation emitted from the back surface of the diaphragm back thereto.

In another aspect, the invention provides a process for inhibiting the production of a shrinkage pipe on the top surface of a metal mass cooling in a mold comprising the steps of inhibiting conductive heat transfer from a region of the metal adjacent the top of the mold into the mold, and returning radiation emitted from the top surface of the metal back thereto.

Accordingly, it is an object of the invention to provide a method of casting large metal parts such as ingots so as to inhibit the formation of a shrinkage pipe. Another object is to provide a mold structure and a mold cap which allow the casting of shrinkage pipe-free ingots and other large metal castings. Yet another object is to improve the yield of metal produced by casting by reducing or eliminating oxidation and other chemical effects which occur on exposure of the metal to the atmosphere.

These and other objects and features of the invention will be apparent from the following description of some preferred embodiments and from the drawing.

BRIEF DESCRIPTION OF THE DRAWING

Like reference characters in the respective figures indicate corresponding parts.

DESCRIPTION OF THE PREFERRED EMBODIMENT

Figure 1:
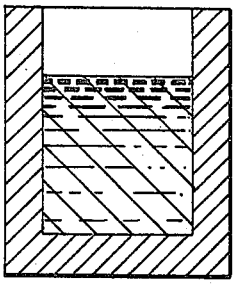
FIG. 1 is a cross-sectional view of a conventional ingot mold containing a mass of liquid metal.
Figure 2:
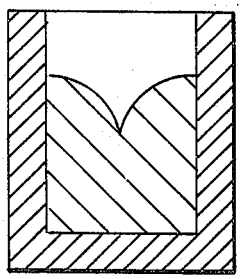
FIG. 2 is a cross-sectional view of the mold of FIG. 1 showing a shrinkage pipe which forms on cooling of the metal mass.

The phenomenon responsible for ingot shrinkage is rapid cooling of the ingot from its exposed top surface. To control shrinkage it is necessary to control the rate of cooling. As solidification and cooling proceed, the surface of a molten steel ingot is at a temperature 2200° F. to 2400° F. Since the intensity of thermal radiation from a surface is proportional to the 4th power of the temperature of that surface, whereas heat transfer by convection is proportional to the first power of the surface temperature, at temperatures near the melting point of steel, virtually all of the heat transferred from the exposed top surface of an input occurs by thermal radiation. Thus, if a surface at absolute temperature T having an emissivity E radiates to an environment at temperature $T_o$, with emissivity $E_o$, the net radiant flux ($q_r$) from each unit area of the surface to the environment is given by the equation:

$$q_r = \frac{\sigma(T^4 - T_o^4)}{1/E + 1/E - 1}$$

where $\sigma = 0.1713 \times 10^{-8}$ BTU/ft$^2$ hr (°F.)$^4$. On the other hand, the rate of heat transfer by convection ($q_c$) from such a surface is given by the equation:

$$q_c = h(T - T_o)$$

where h is the film coefficient which, for hot horizontal surfaces facing upward, equals about 1.5 BTU/ft$^2$ hr °F. When E=0.95, $E_o$=1, T=2860° R. (2400° F.), and $T_o$537° R. (77° F.) it may be seen that $q_r$ has a value of 108,744 BTU/ft$^2$ hr. whereas $q_c$ has a value of only 3484 BTU/ft$^2$ hr. Thus, as an approximation, one may neglect all but the radiant loss of heat from the top surface of an ingot and assume that that surface will radiate approximately 110,000 BTU/hr. ft$^2$ into the atmosphere. As the surface of the ingot cools to about 2200° F., this radiant flux will decrease to approximately 86,000 BTU/hr. ft$^2$.

Broadly, the invention contemplates reducing the net radiative heat loss from the ingot surface, and thus reducing the rate of cooling at the ingot surface to a level more in conformity with other portions of the metal casting, by returning the emitted radiant energy back to its source. By itself, this approach is effective to reduce significantly the tendency of a cooling ingot to form a shrinkage pipe. However, the return of radiation may be combined with other means of reducing the net rate of surface cooling so as to result in a substantially flat topped solid ingot. Thus, the mold body may be provided with insulation adjacent its open top to reduce conductive heat transfer into the mold body. The interior of the structure may be evacuated to reduce convective heat loss. Also, it is possible to provide heat directly to top surface layers of the solidifying ingot with radiant heat lamps, an induction coil, or a pair of electrodes which pass a current through the layers. Various combinations of these approaches to retarding the cooling rate of the exposed ingot surface are contemplated. As used in this specification and the appended claims, the term "ingot" refers collectively to large metal castings.

One method for returning thermal radiation to the surface of the ingot involves the use of the heat recuperators disclosed in U.S. Pat. Nos. 4,082,414 and 4,160,577, the disclosures of which are incorporated herein by reference. The reflective devices disclosed in these patents are capable of returning as much as 90 percent of the radiation emitted from a source and may be placed at a distance from the top of the ingot. Such heat recuperators may be placed, for example, on the ceiling in a room where casting is done.

However, the preferred method of returning the radiant heat is by providing a cap structure which fits over the top of the mold and comprises, as essential elements, a diaphragm constructed of a material having a melting point above that of the molten metal to be cast disposed parallel to the top surface of the casting so as to intercept thermal radiation emitted therefrom, and a means for returning radiation emitted from the opposite surface of the diaphragm back thereto. In one embodiment, radiation is returned by a reflector integral with the cap. In another embodiment, the radiation is returned by a stack of baffles arranged in parallel. Such cap structures may be used with a conventional casting mold or preferably with a specially designed mold featuring either or both insulation to retard conductive heat losses in regions adjacent the top of the casting and means for supplying heat to top surface layers of the casting.

Figure 3:
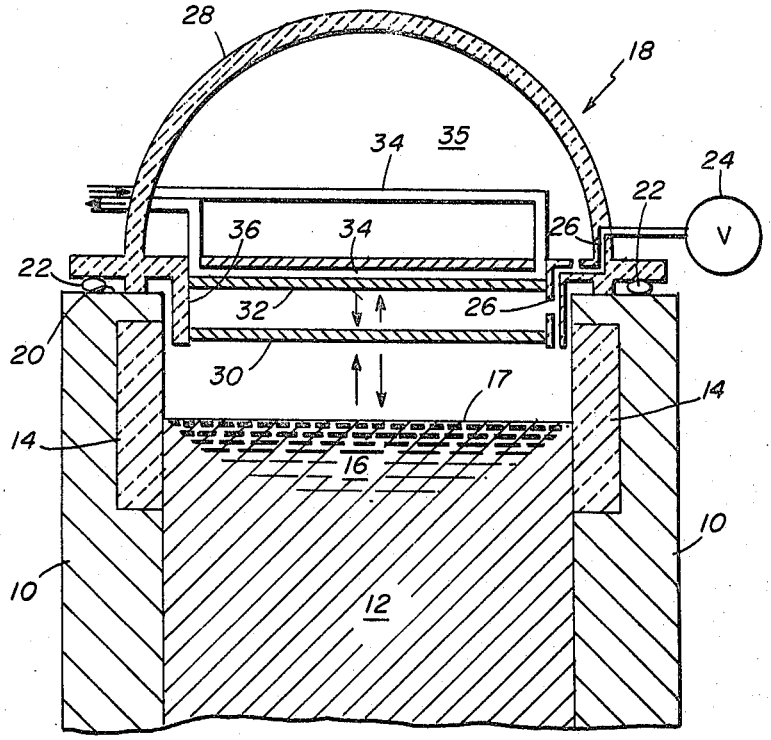
FIG. 3 is a cross-sectional view of a mold structure embodying the invention.

Referring to the drawing, FIG. 3 illustrates an ingot mold having a mold body 10 within which a mass of metal 12 has partially solidified. Integral with the mold body is an insulation layer 14 which inhibits transmission of heat by conduction from liquid layer 16 of the ingot into the mold body 10. Layer 16 extends about the inside surface of mold body 10. A mold cap 18 rests on the top surface 20 of mold body 10. An O-ring 22 or other conventional sealing device seals the cap to the mold body so that a "roughing" vacuum, on the order of $10^{-2}$ atm., may be produced within the cap and mold by vacuum pump 24 via suitable ports and ducts 26. The cap comprises a domed housing 28, a thin, light-weight diaphragm 30, and an infrared reflector 32 disposed to face the back side of the diaphragm 30. The reflector preferable is characterized by a reflectivity of at least 0.5. A cooling loop 34 circulates a fluid coolant in heat exchange relation or with the reflector 32 to maintain the temperature of the reflector at levels below which the reflector may be degraded, e.g., less than about 1,000° F.

The material from which the cap is made should be capable of service at high temperatures. In particular, diaphragm 30 and its associated support structure 36 should be capable of service at temperature in excess of the temperature of the liquid metal 16. The vacuum is drawn via conventional ducts to produce a subatmospheric pressure simultaneously on both sides of diaphragm 30, and preferably also in the space 35 within the housing 28. This arrangement insures that reflector 32, its associated cooling loop 34, and especially the thin diaphragm 30 remain free of potentially destructive pressure differentials at all times. The housing 28 preferably takes the form of a dome or arch (for example, a hemisphere) so that it can support more easily the external pressure of the atmosphere. With this housing design, one can employ, for example, a brittle ceramic material for the housing 28. Once the interior of the structure has been evacuated, the pressure of the atmosphere is carried entirely by the housing 28 and its internal parts are free of load. Auxiliary cooling (not shown) may be incorporated either in the cap 18 or adjacent the top of the mold body 10 so that conventional roughing vacuum seal materials such as a polymeric or a metallic O-ring 22 can be used without danger of degradation. Non-limiting materials which may be used in fabricating the cap structure, and especially diaphragm 30, are listed in the table below.

TABLE

| Material | Maximum Temperature at which Material May Be Used | |
|---|---|---|
| Thoria-dispersed nickel | | 2300° F. |
| Tungsten | greater than | 3000° F. |
| Lithium-alumina-silica glass | | 2200° F. |
| Alumina | | 3300° F. |
| Silicon carbide | | 3000° F. |
| Silica | | 2800° F. |
| Tungsten carbide | | 5000° F. |
| Platinium | | 3000° F. |

The lithium-alumina-silica (LAS) glass is available commercially under the trademark CERVIT. Various combinations of these materials and others may be used as desired. In the situation where diaphragm 30 is constructed of a material that could be damaged when exposed to the temperature of the molten metal, auxiliary cooling may be employed to maintain its temperature at suitable levels. However, in all cases, the diaphragm should have a melting point above that of the cast metal.

The reflector 32 preferably takes the form of a specular reflective coating applied by vapor deposition or other conventional techniques comprising gold, aluminum, or copper. A protective oxide film may be deposited upon the reflecting surface. Materials such as $TiO_2$, $ZrO_2$, MgO, or $Al_2O_3$ as well as various proprietary glass ceramics may be employed. The thickness of the properties coating should be approximately 1,000 Angstroms in order to avoid undesirable interference effects and to attain high transmission levels in the infrared.

Figure 4:
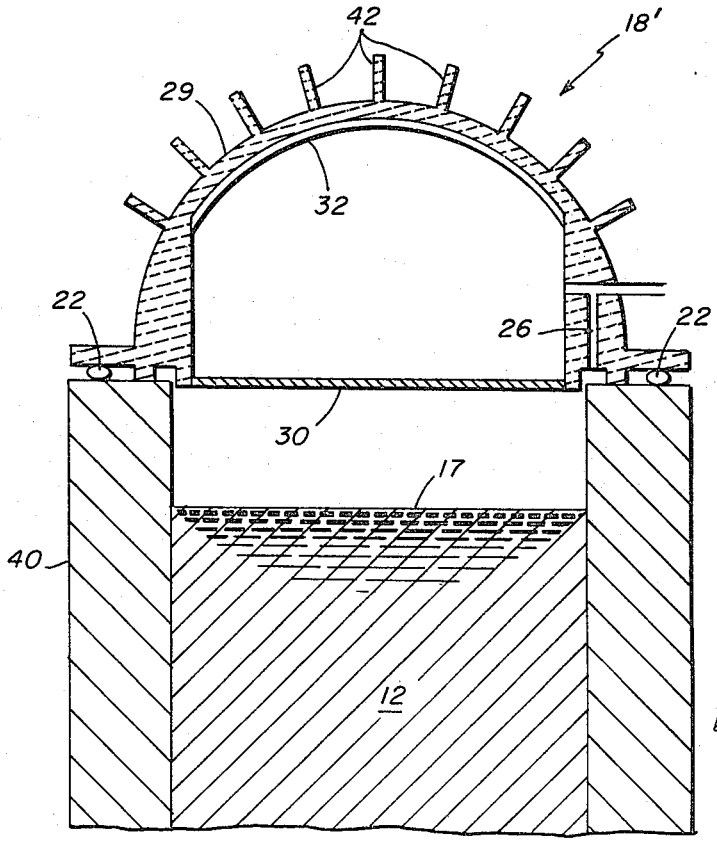
FIG. 4 is a cross-sectional view of a mold cap embodying the invention in place on a conventional ingot mold.

Referring to FIG. 4, a second embodiment of the invention is shown. It comprises a cap structure 18' for use with a conventional casting mold 40. Cap 18' may also be used in connection with the molds illustrated in FIGS. 3, 5, 6, 7 or 8. Cap 18' comprises a domed housing 29 having a plurality of integral fins 42 which serve to increase the exterior surface area of the dome, and an interior infrared reflective surface coating 32. A diaphragm 30 is disposed in face-to-face relation with the top surface 17 of the partially solidified ingot 12. As with the embodiment of FIG. 3, both sides of diaphragm 30 within the structure may be evacuated simultaneously through ports 26.

The operation of the embodiment of FIGS. 3 and 4 are similar. Once a subatmospheric pressure (roughing vacuum range) has been produced within the structure, the only mechanisms through which heat can be transferred out of the molten metal at the top of the mold are conduction through the mold body 10 and the structure of the cap and by radiation from the molten metal to the diaphragm. Convection is substantially eliminated because of the low pressure within the mold. In the embodiment of FIG. 3, the effect of conduction through the mold body 10 is controlled by insulation layer 14 and through design of the structure of the cap. For example, the use of materials such as CERVIT, which has a relatively low thermal conductivity, is advantageous in this respect. Even without insulation 14 (see FIG. 4) the contribution which conduction makes to cooling of the molten metal is minor compared with the effect of radiation, but this small contribution can be further reduced with the use of insulation as shown at 14 in FIG. 3. Thus, in both embodiments, the diaphragm 30 in effect serves as an ambient atmosphere to which the metal radiates; thermal radiation emitted from ingot surface 17 impinges upon and is absorbed by diaphragm 30. At the outset, the net radiative flux between the metal surface and diaphragm is heavily toward the diaphragm. However, as the temperature of the diaphragm increases, it increasingly emits radiation back toward surface 17.

For example, a freshly cast steel ingot or other large metal part at 2700° F., if radiating to the ambient atmosphere at 77° F., would give up approximately 171,000 BTU/ft$^2$ hr. However, if the molten metal is facing diaphragm 30, which is at a temperature of 2500° F., the rate of transfer from the top of the metal would be approximately 40,000 BTU/ft$^2$ hr, i.e., about 23 percent of the rate that would occur if the molten metal were radiating directly into the atmosphere. If the diaphragm were at 2300° F., the rate of radiant heat loss from the metal to the diaphragm would be approximately 72,000 BTU/ft$^2$ hr. This is approximately 42 percent of the loss that would occur if the molten metal were to radiate freely to the atmosphere.

Diaphragm 30, when heated, emits radiation both from its front surface facing the ingot 12 and its back surface. In the embodiments of both FIGS. 3 and 4, radiation emitted upwardly from the diaphragm 30 is reflected at 32 and returned to the diaphragm 30. To obtain the low net radiative flux in the first example above with the diaphragm at 2500° F., the reflector would have to return to the diaphragm approximately 70 percent of the heat radiated from the diaphragm. In the second example, with the diaphragm at 2300° F., the reflector must return approximately 27 percent of the radiation emitted by the diaphragm. Reflective materials of the type mentioned above can easily attain the required reflectivities. In fact, commercially available coatings can provide reflectivities of 95 to 97 percent in the range of wavelengths of importance here.

One is required to prevent the temperature of most reflective materials from rising to very high levels. For example, certain very effective coatings can be used only to temperatures of approximately 1,000° F. and suffer damage at temperatures above this level. For this reason, auxiliary cooling loop 34 is provided in the cap structure illustrated in FIG. 3 and fins 42 are provided in the structure of FIG. 4. Thus, as reflective coating 32 in FIG. 4 increases in temperature, a temperature gradient develops across the dome 29 and fins 42. Heat may be dissipated through the fins and dome surface, possibly with the aid of a fan to promote convection. When insulation is employed as shown in FIG. 3, the means for cooling the reflector 32 comprises essentially the only path for removal of heat from the surface layer of the cast metal.

If no heat whatever were to escape to the atmosphere from the upper surface of the diaphragm, the diaphragm would come to thermal equilibrium with the molten metal and thus would reach the same temperature as the metal. Thus, by controlling the net rate at which the diaphragm is cooled, one can cause the temperature of the diaphragm to approach, as closely as may be desired, the temperature of the molten pool of metal. In doing so, it is advantageous to use a diaphragm which can be safely heated to a temperature that exceeds that at which the metal being cast solidifies. The major function of the diaphragm is to protect the reflector from damage it might suffer if exposed directly to the molten pool of metal in the top of the ingot mold. For example, hot gases in the convection pattern that develop over the molten pool of metal immediately after casting could sweep metal particles, slag, or other forms of dirt up against the reflector. Also, the same hot gases could heat the reflector to temperatures approaching that of the molten metal itself. However, the diaphragm protects the reflector from direct contact with gases, particulates, etc. which could be swept up above the molten metal as the cap is installed, positioned and evacuated. The vacuum system protects the reflector from convective heating by the gases in the space between the diaphragm 30 and reflector 32. In addition, it eliminates convection above the molten metal pool. This helps substantially to reduce the rate of heat loss from the molten metal once the combination of the diaphragm and the reflector have reduced the heat loss by radiation. The vacuum also reduces the amount of scale formed on the ingot surface.

In view of the foregoing, it will be apparent that if the diaphragm is constructed from thin, lightweight material, its heat capacity will be low and it will not introduce a delay in heating the gases between the diaphragm and the reflector. However, in some embodiments it may be useful to use a diaphragm with a somewhat greater mass so that its heat capacity may be used to delay or buffer heating of the gases behind it, thereby providing time to install and evacuate the cap.

It thus may be appreciated that if e.g., steel, is cast at a temperature of 3000° F., so long as the diaphragm of FIGS. 3 and 4 can be used safely at this temperature, it can serve as a thermal image of the molten steel throughout its thermal history after casting. Thus, cooling of the ingot can be retarded so that no shrinkage pipe is formed.

Referring again to FIG. 4, and assuming that the reflector 32 must be prevented from rising to a temperature above about 1000° F., it may be seen that the difference in temperature between the surface of reflector 32 and associated fins 42 and the ambient air (77° F.) is approximately 900° F. If, as illustrated, the reflector were formed directly on the interior of dome 29, if a temperature gradient of 100° F. were allowed to develop across the thickness of the dome, and if the exterior surface area of the dome were twice as great as that of the liquid metal pool atop of the ingot, then the outer surface of the dome would have to dispose of approximately 4,270 BTU/ft$^2$ hr while being at a temperature of 800° F. greater than the air. This cooling flux could be attained by a convection coefficient (h) within the 5–6 range. A coefficient of this magnitude can be attained easily in air by using mildly forced convection, e.g. a simple fan. In fact, it may be possible to achieve this heat exchange without the use of fins 42.

Figure 5:
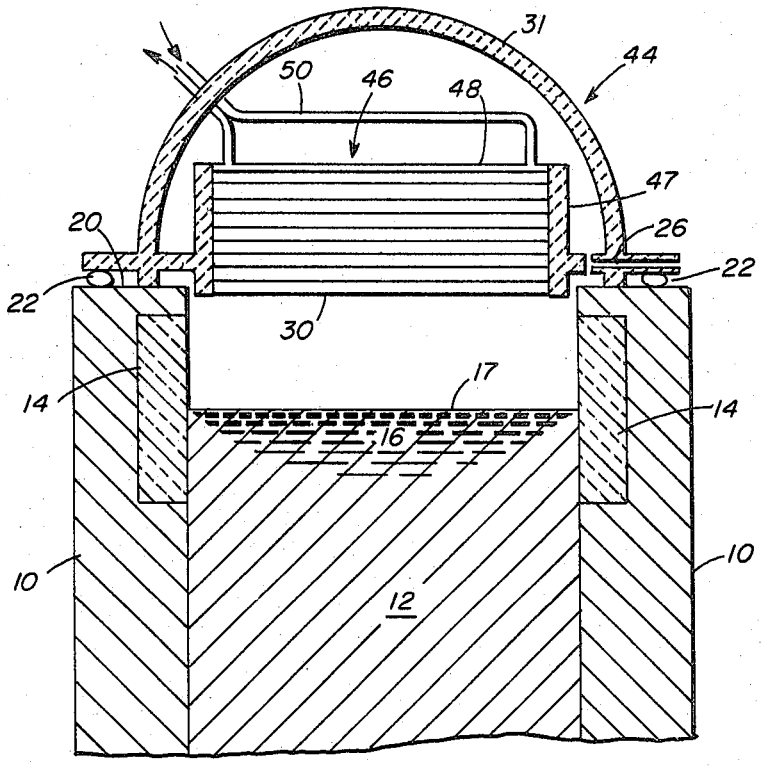
FIG. 5 is a cross-sectional view of a second embodiment of the mold structure of the invention.

Referring to FIG. 5, still another embodiment of the invention is illustrated. It comprises a mold body 10 furnished with insulation 14 identical in construction to the insulation of FIG. 3. The cap 44 comprises a domed housing 31 equipped with suitable ducting 26 for producing a subatmospheric pressure within the mold structure and a diaphragm 30 disposed in face-to-face relation with the top surface 17 of a solidifying mass of metal 12. However, in place of the reflector 32 of the embodiments of FIGS. 3 and 4, the cap employs a plurality of stacked baffles 46. The top baffle 48 of the stack 46 is serviced by a cooling loop 50 which circulates cooling fluid in heat conducting relation to baffle 48.

When thin baffles, each having emissivity E, are placed between a radiating surface with emissivity E at a temperature $T_1$ and the environment with emissivity E at temperature $T_o$, the rate of radiant heat transfer from the surface to the environment is reduced from:

$$q_r\,(\text{no baffles}) = \frac{(T_1^4 - T_o^4)}{1/E + 1/E - 1} = \frac{E(T_1^4 - T_o^4)}{2 - E}$$

to:

$$q_r\,(n\ \text{baffles}) = \frac{E(T_1^4 - T_o^4)}{(n+1)(2-E)}$$

(See, e.g., Handbook of Heat Transfer, Rohensow and Hartnet, McGraw Hill, 1973, pp 3–100.)

Thus, $$\frac{q_r\,(n\ \text{baffles})}{q_r\,(\text{no baffles})} = \frac{1}{n+1}$$

A somewhat different result obtains if the emissivities of the radiant sources, the baffles, or the environment differ, but the effect of such differences is minor unless the differences in emissivities becomes pronounced.

If the radiant losses are to be reduced by 90 percent by using baffles, then $1/(n+1)$ must equal 0.10 and n must equal 9, i.e., 9 baffles must be used. To reduce radiant losses by 95 percent requires that $1/(n+1)$ equals 0.05, and 19 baffles are necessary. For a 97 percent reduction, 33 baffles are required. Thus, as the desired reduction of radiant loss increases, the number of baffles which must be employed increases sharply. Thus, where it is sought to reduce radiant heat losses from the back surface of diaphragm 30 only moderately, e.g., on the order of 90 percent or less, the use of baffles may be more practical and less expensive than the use of a reflector. However, when, for example, a 97 percent reduction is sought, attempts to use baffles which may lead to an overly complicated or fragile structure, in which case a single high quality reflector is preferred.

One of the major advantages of using baffles as opposed to a reflector is that the baffles are far less susceptible to damage by hot gases. Thus a system for evacuating the cap is a less critical component of this embodiment than of the reflector embodiments. Auxiliary cooling is still required to extract heat from the cap. Such means for cooling can be applied either to the top baffle, as shown in FIG. 5, to the dome itself, as shown in FIG.

4 (with the omission of reflective surface 32), or to another suitable location.

Even though it is not necessary to protect the surfaces of the baffles from the type of contamination that could harm a reflective surface, it is nevertheless advisable but not required to use a vacuum system, as this would substantially eliminate the convective heat losses from the liquid metal to the mold and minimize chemical effects on the ingot surface. With the liquid metal at, for example, 2700° F., the convective loss of heat to the atmosphere, even taking into account the impedance offered by the structure of the mold cap, will be on the order of 3,000 BTU/ft$^2$ hr. If baffles were used to reduce the rate of heat loss from the metal to 5 percent of that which would occur if the metal could radiate freely to the environment, the heat loss by radiation would be reduced from about 171,000 BTU/ft$^2$ hr to about 8,550 BTU/ft$^2$ hr. The additional loss by convection of 3,000 BTU/ft$^2$ hr would have two effects: it would increase the total heat loss by about 35 percent (increasing it from 5 to 7 percent); and it could cause the distribution of temperature in the baffle stack to depart substantially from that which would obtain in the absence of convection. This, in certain circumstances, can increase the rate of radiant heat transfer through the baffle stack and can in fact undo the effect intended.

As a minimal measure to suppress the effects of convection, it is advisable to insure that diaphragm 30 is sealed sufficiently well to the baffle support structure 47 to prevent the flow of gas from the space directly above the liquid metal up through the baffle assembly. Also, it is possible to select a spacing between the multiple baffles so as to control convection in the spaces. By making the spaces sufficiently small, it is possible to suppress convection entirely and to confine heat transfer through the gas between the baffles to the conduction mechanism. To achieve this result, both highly effective sealing of the edges of the baffle plates and control of thermal distortion of the plates are required. If, through thermal distortion, the plates were to touch over significant areas, heat conduction directly through the plates could undo the effect sought. The sealing of the edges of the plates and the control of thermal distortion can both be accomplished through conventional design techniques. Thus, there is a design tradeoff between employing a vacuum system to control heat transfer and fabricating a sealed stack of baffles which must be resolved on economic considerations of material costs, fabrication costs, and reliability of performance.

The baffles may be constructed of a material similar to those set forth above for making diaphragm 30. One potentially attractive fabrication technique is to construct the entire baffle plate assembly of thin pure aluminum foil, and then to anodize the foil structure to convert its aluminum content to $Al_2O_3$, which can serve at temperatures as high as 3,300° F.

Figure 6:
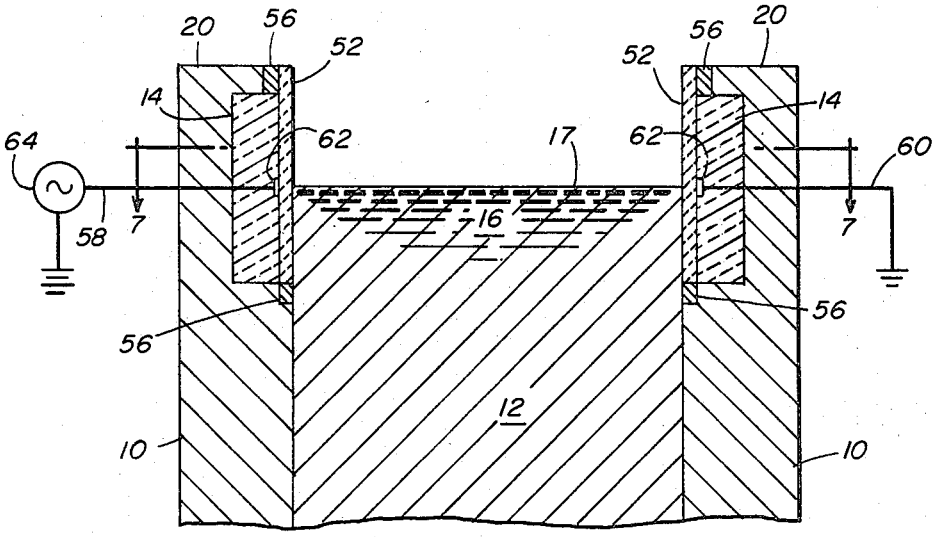
FIG. 6 is a cross-sectional view of an ingot mold for use with a mold cap of the invention showing means for heating surface regions of an ingot.
Figure 7:
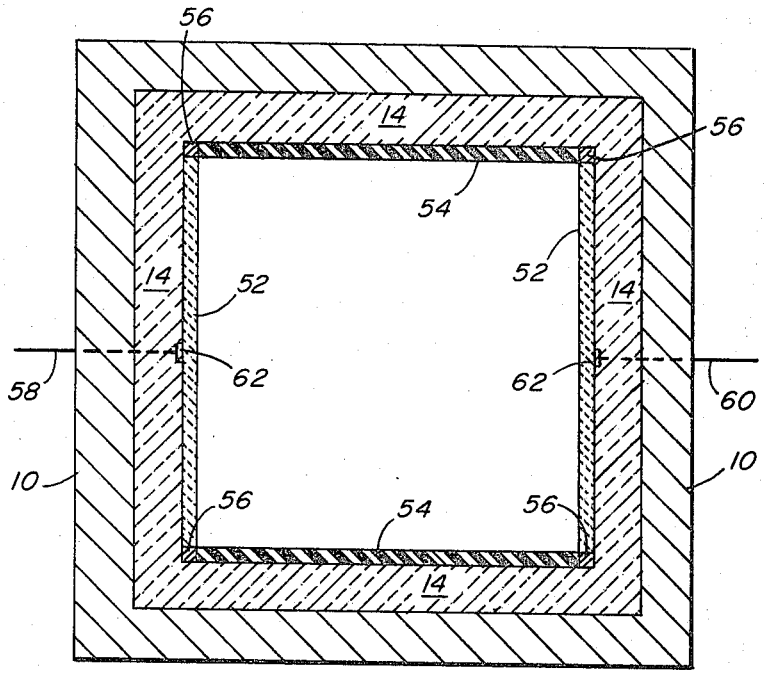
FIG. 7 is a cross-sectional view of the mold of FIG. 6 taken at line 7—7.

Referring to FIGS. 6 and 7, a modified mold structure for use with the mold caps of FIGS. 3, 4 or 5 is shown. This design features, in addition to insulation layer 14 about the interior walls of the upper regions of the mold body 10, a pair of refractory electrodes 52 for passing a current through surface regions of the cast metal mass 12. Electrodes 52 are positioned on opposite sides of the mold body 10 and are separated from each other by transverse insulating plates 54. Each electrode is electrically isolated by suitable nonconducting mountings 56 and is serviced by leads 58, 60 and their associated contacts 62. Preferably, as will be explained more fully below, the electrodes receive high frequency alternating current supplied by high frequency generator 64.

This embodiment of the structure of the invention may be employed in situations where the liquid metal pool 17 cools too rapidly despite the use of insulation layer 14 and a cap of the type disclosed above. Since, in accordance with the invention, loss of heat from the surface area 17 of liquid metal mass 16 occurs substantially entirely by thermal radiation from the surface of the metal, one can supply energy to this area such that only the surface of the metal is heated. The net radiant heat loss may then be offset to the degree required to reduce the rate of cooling and solidification. To provide makeup heat to the ingot surface 17, it is possible to employ high temperature electric heaters or infrared heaters located directly above the metal surface and mounted, for example, on the cap support structure. However it is preferred to employ electrodes as shown in FIGS. 6 and 7.

The application of a high frequency electric field to a metal results in a current which tends to flow very close to the surface of the metal. The depths ($\delta$) to which current penetrates ferrous metals, at various frequencies ($\omega$) are given in the table below.

| $\delta$(inches) | $\omega$(Hertz) |
|---|---|
| 2.60 | 60 |
| 0.39 | 3,000 |
| 0.20 | 10,000 |
| 0.03 | 450,000 |

Thus, it is apparent that the application of high frequency fields to the liquid metal pool can produce electrical dissipation heating that is confined to a very thin layer (e.g. 0.20 to 0.03 inches thick). This creates a heated "skin" on the metal, and the power dissipated in the skin can compensate for the radiational cooling of the metal. Furthermore, if the temperature of the surface of the metal is not uniform, the electrical current tends to concentrate in those zones at lower temperature because these zones would also have a lower electrical resistance. Thus, if the metal in the top of the mold had begun to solidify from the boundary of the mold inward, a high frequency electrical current would concentrate in the cooler solidified zones and would tend to induce melting. This affect would of course tend to prevent the development of a shrinkage pipe.

Suitable materials for fabricating insulators 56 include alumina; platinum sheet mounted on alumina or some other substrate to provide structural support can be used for the plate electrodes. In any event, the materials for the nonconducting plate and for the electrodes must be selected so that they do not react with the molten metal. Other non-limiting examples of materials for use in fabricating the electrodes include osmium (mp 5477° F., electrical resistivity 9Ω/cm) or molybdenum (mp 4750° F., electrical resistivity 5.2Ω/cm).

By monitoring the temperature of the metal at the top of the mold, one can determine whether its solidification is proceeding as desired. If not, e.g., if a significant shrinkage or the development of a pipe is detected, electric current may be discharged through the material by energizing high-frequency generator 64 to retard the rate of cooling and thus prevent shrinkage.

The disclosure set forth above demonstrates that heat loss from molten metal at 2700° F. can be reduced to less than about 1700 BTU/ft$^2$ hr. By applying 5 kw/ft$^2$ of high-frequency power to the metal through the electrodes described in FIGS. 6 and 7, one can entirely balance this heat loss. Thus, a relatively small high frequency power supply (5 kw/ft$^2$ of ingot cross section) will be sufficient to adjust the rate of cooling of the ingot as may be necessary to prevent shrinkage.

Figure 8:
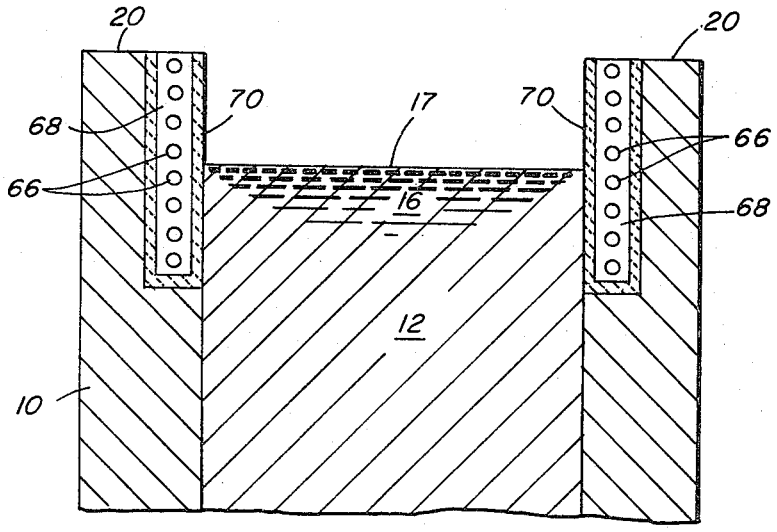
FIG. 8 is a cross-sectional view of an ingot mold for use with a mold cap of the invention showing an induction coil for heating surface regions of an ingot.

FIG. 8 illustrates another mold design which includes means for heating surface regions of the ingot 12. This structure includes an induction coil 66, which may comprise a thin metallic tube through which cooling fluid is circulated. The coil 66 is disposed within a refractory electrical insulation 68 which is jacketed by a ceramic liner 70. Upper regions of the casting 12 may be heated to achieve the same effects discussed above by passing alternating current through the coils.

The invention may be embodied in other specific forms so without departing from the spirit and scope thereof. Accordingly, other embodiments are within the following claims.

What is claimed is:

1. A mold structure for casting metal ingots characterized by an upper surface shrinkage pipe of reduced size relative to ingots cast in an open-top mold, said mold structure comprising:

a mold body having a top opening; and a mold cap for placement over said opening, said cap comprising:

a diaphragm of material having a melting point higher than the metal to be cast, said diaphragm having a bottom surface and a top surface, said bottom surface being disposed, when said mold cap is positioned on said mold body, to intercept radiation emitted from and to re-emit radiation toward the top surface of a liquid metal mass placed in said mold body; and means for returning radiation emitted from the top surface of said diaphragm back thereto.

2. The structure of claim 1 further comprising insulation means adjacent said top opening for inhibiting conductive heat transfer from the metal mass into said mold body.

3. The structure of claim 1 further comprising means for sealing said cap to said mold body and means for producing a subatmospheric pressure within said structure.

4. The structure of claim 1 further comprising means for heating a portion of a metal mass placed in said mold body in a region adjacent said top opening.

5. The structure of claim 4 wherein said means for heating comprises means for passing an electric current through said region.

6. The structure of claim 5 wherein said means for heating comprises means for passing high frequency alternating current and said region substantially comprises a surface layer of the metal mass.

7. The structure of claim 4 wherein said means for heating comprises an induction heating coil.

8. The structure of claim 1 wherein said means for returning comprises an infrared reflector and means for cooling said reflector.

9. The structure of claim 8 wherein said reflector has a reflectivity of at least 0.5.

10. The structure of claim 8 wherein said means for cooling comprises a heat conducting structure for dissipating heat into the atmosphere.

11. The structure of claim 8 further comprising means for sealing said cap to said mold body and means for producing a subatmospheric pressure within said structure.

12. The structure of claim 1 wherein said means for returning comprises a plurality of baffles stacked on the top surface side of said diaphragm within said cap.

13. The structure of claim 12 further comprising means for sealing said cap to said mold body and means for producing a subatmospheric pressure within said structure.

14. The structure of claim 12 further comprising means for removing heat from at least one of said baffles.

15. The structure of claim 1 further comprising:

means for sealing said cap to said mold body;

means for producing a subatmospheric pressure within said structure; and means for removing heat from said cap.

16. The structure of claim 15 further comprising insulation means for inhibiting conductive heat transfer into said mold body adjacent said top opening.

17. The structure of claim 16 further comprising means for heating a portion of a metal mass placed in said mold body in a region adjacent said top opening.

18. The structure of claim 15 wherein said cap includes a housing comprising a dome for supporting the atmosphere where said subatmospheric pressure is produced within said structure.

19. A cap for use with a mold for casting metal ingots, said cap being effective to reduce the size of the shrinkage pipe which forms during solidification of an ingot on the top surface thereof, said cap comprising:

a housing including a portion for mounting said cap on a mold;

a diaphragm of material having a melting point higher than the metal to be cast, said diaphragm having a top surface and a bottom surface, said bottom surface being disposed, when said cap is positioned on a mold, to intercept radiation emitted from and to re-emit radiation toward the top surface of a liquid metal mass placed in the mold; and means for returning radiation emitted from the top surface of said diaphragm back thereto.

20. The cap of claim 19 further comprising means for sealing said cap to a mold and means for producing a subatmospheric pressure within said mold.

21. The cap of claim 19 wherein said means for returning comprises an infrared reflector and means for cooling said reflector.

22. The cap of claim 21 wherein said reflector comprises a coating on an inside surface of said housing and said means for cooling comprises a surface on the exterior of said housing for transferring heat to the atmosphere.

23. The cap of claim 21 further comprising means for sealing said cap to a mold and means for producing a subatmospheric pressure within said mold.

24. The cap of claim 19 wherein said means for returning comprises a plurality of baffles stacked on the top surface side of said diaphragm.

25. The cap of claim 24 further comprising means for sealing said cap to a mold and means for producing a subatmospheric pressure within said mold.

26. The cap of claim 24 further including means for removing heat from said cap.

* * * * *

UNITED STATES PATENT AND TRADEMARK OFFICE

CERTIFICATE OF CORRECTION

PATENT NO. : 4,290,475

DATED : September 22, 1981

INVENTOR(S) : Charles A. Berg

It is certified that error appears in the above-identified patent and that said Letters Patent are hereby corrected as shown below:

Abstract, line 8, "reemit" should read --re-emit--.

Column 3, line 35, "input" should be --ingot--.

Column 4, line 63, delete "or".

Table, Column 5, "platinium" should be --platinum--.

Column 5, line 55, "properties" should be --protective--.

Column 12, line 28, "where" should be --when--.

Signed and Sealed this

*Twenty-seventh* Day of *April 1982*

[SEAL]

*Attest:*

*Attesting Officer*

GERALD J. MOSSINGHOFF

*Commissioner of Patents and Trademarks*